US006746601B2

(12) United States Patent
Dorin et al.

(10) Patent No.: US 6,746,601 B2
(45) Date of Patent: Jun. 8, 2004

(54) REMOVABLE CONFORMAL LINERS FOR CENTRIFUGE CONTAINERS

(75) Inventors: Melvin Dorin, Mountain View, CA (US); Patrick Q. Moore, Gilroy, CA (US)

(73) Assignee: Beckman Coulter, Inc., Fullerton, CA (US)

( * ) Notice: Subject to any disclaimer, the term of this patent is extended or adjusted under 35 U.S.C. 154(b) by 0 days.

(21) Appl. No.: 10/213,018

(22) Filed: Aug. 5, 2002

(65) Prior Publication Data

US 2002/0185432 A1 Dec. 12, 2002

Related U.S. Application Data

(62) Division of application No. 09/607,232, filed on Jun. 30, 2000, now Pat. No. 6,458,067.

(51) Int. Cl.[7] ..... B04B 7/12; B65D 25/14

(52) U.S. Cl. ..... 210/188; 210/541; 215/12.1; 220/495.01; 220/495.04; 422/72; 422/102; 494/21; 494/45

(58) Field of Search ..... 210/188, 541; 215/12.1; 220/495.01, 495.04; 422/72, 102; 494/21, 45; 426/411; 491/21, 45

(56) References Cited

U.S. PATENT DOCUMENTS

| | | | | | |
|---|---|---|---|---|---|
| 3,239,136 | A | * | 3/1966 | Hein | 494/45 |
| 3,610,455 | A | * | 10/1971 | Greenhalgh et al. | 215/12.1 |
| 4,098,456 | A | | 7/1978 | Bayham | 494/21 |
| 4,120,927 | A | | 10/1978 | Nielsen | 264/534 |
| 4,142,670 | A | * | 3/1979 | Ishimaru et al. | 494/45 |
| 4,294,369 | A | | 10/1981 | Racine | 215/311 |
| 4,413,773 | A | | 11/1983 | Rohde et al. | 494/37 |
| 4,459,793 | A | * | 7/1984 | Zenger | 426/411 |
| 6,019,716 | A | | 2/2000 | Forestell et al. | 494/21 |
| 6,458,067 | B1 | * | 10/2002 | Dorin et al. | 494/45 |

* cited by examiner

*Primary Examiner*—David A Reifsnyder
(74) *Attorney, Agent, or Firm*—Hogan & Hartson, LLP

(57) ABSTRACT

A removable conformal liner for a centrifuge container is described. The liner has a flexible or semi-rigid body with an opening for introducing a sample. When the liner is inserted into an internal cavity of a centrifuge container, the body of the liner conforms to the interior cavity. The liner body may be made of a material that is sufficiently resilient to allow a reversible deformation of the body by folding, twisting, collapsing, rolling, or pleating.

5 Claims, 6 Drawing Sheets

Fig. 5C
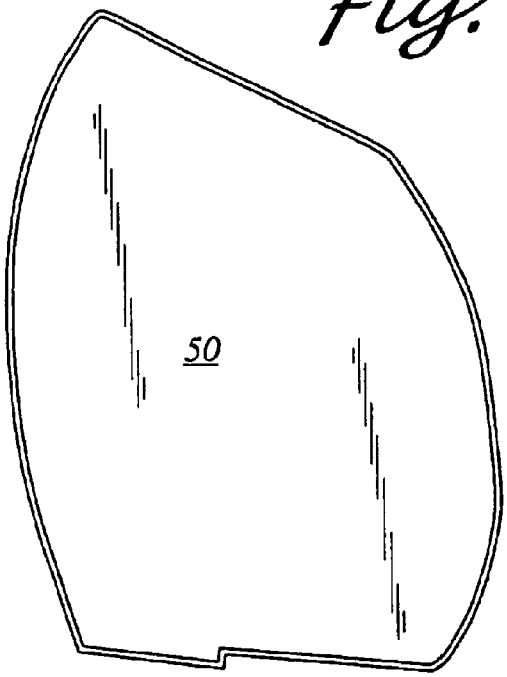
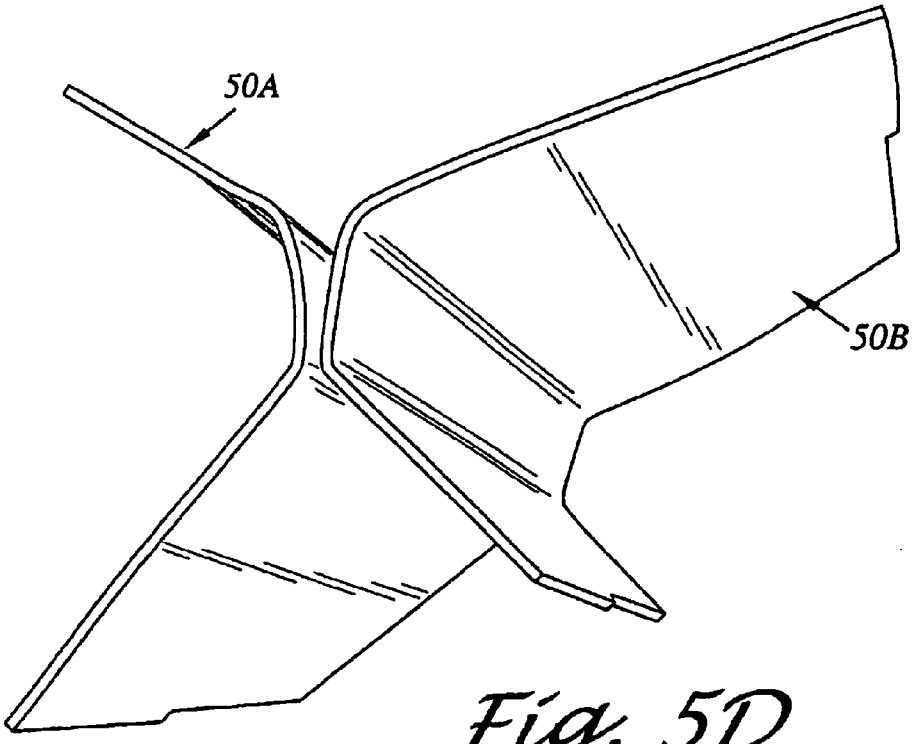
Fig. 5D

REMOVABLE CONFORMAL LINERS FOR CENTRIFUGE CONTAINERS

This is a divisional of application Ser. No. 09/607,232 filed Jun. 30, 2000, now U.S. Pat. No. 6,458,067 which is hereby incorporated by reference in its entirety.

AREA OF THE ART

The invention relates to removable liners for centrifuge containers and a method of using such liners for separating solids from suspensions by centrifugation.

DESCRIPTION OF THE PRIOR ART

Centrifugation is a widely used method for separating solid and liquid phases of suspensions. The solid phase is more dense than the liquid phase, and during centrifugation, solids settle at the bottom of the centrifuge container, forming a dense pellet. The lighter liquid phase forms a top layer, also called a supernatant. At the end of centrifugation, the supernatant can be decanted and the pellet harvested or discarded. The initial separation step may be followed by wash steps. During a wash step, the pellet is resuspended in a wash liquid. The resuspended solid component then may be pelleted once again by means of centrifugation and the supernatant wash liquid decanted from the container. In certain applications, this step can be repeated several times with the same or a different wash liquid.

Currently, tube-carrying rotors, as well as bowl-type centrifuge rotors, are available on the market. The following discussion is limited to tube-carrying rotors of which there are three main types: swinging bucket rotors, fixed angle rotors and vertical tube rotors. All three types of tube-carrying rotors include a plurality of symmetrically located cavities, adapted to receive sample containers. Sample containers for centrifugation are manufactured in a variety of sizes, materials, wall thicknesses and sealing means to accommodate chemically active samples and a wide range of operating conditions.

The existing designs of centrifuge containers, however, do not offer an easy access to pellets for their harvesting or disposal. In applications dealing with diluted suspensions, complete harvesting of a pellet can be particularly difficult. In some applications, sample containers have to be cut to retrieve a pellet, which is not always an economically feasible option. Also, existing centrifuge containers cannot accommodate applications where the pellet is a hazardous material (e.g., a biohazard) and a minimal direct handling of the pellet by a technician is desirable. Furthermore, cleaning of the centrifuge containers from the solids remaining on the walls after the pellet is harvested requires laborious and tedious scrubbing and washing. The difficulty of thorough cleaning of the centrifuge container further increases as the dimensions of the neck opening of the container decreases. That is, whereas some types of solid residue may be easily cleaned from wide-mouthed bottles, such residue becomes more difficult to remove where the bottle is of narrow-mouthed construction. Also, the manufacturing of conventional centrifuge containers requires that materials are selected according to their structural strength and fatigue resistance, and not necessarily for their chemical or sterilization resistance. However, the mechanical strength of the materials does not always correspond to their chemical and physical resistance. Consequently, certain chemically aggressive materials cannot be processed in conventional centrifuge containers or require bulky and expensive designs. Finally, when an aseptic procedure is called for, the centrifuge containers have to be sterilized, which often takes 30–60 minutes. This relatively long preparation time of a conventional centrifuge container further decreases efficiency of the sample processing.

The conventional centrifuge container designs, therefore, fail to provide convenient methods for the separation of solids by centrifugation with little or no time required for cleaning and sterilization of the containers prior to the next centrifugal cycle. The conventional designs are also limited to only certain types of samples that can be processed.

SUMMARY OF THE INVENTION

It is an object of the present invention to develop a cost-efficient, rapid and convenient method for the separation of the solids from suspensions by centrifugation. Particularly, it is an object of the present invention to develop a centrifuge container assembly that minimizes the time required for its cleaning, reduces direct exposure of a technician to hazardous pellets and, at the same time, increases the efficiency of the pellet harvesting. It is also an object of the present invention to develop a centrifuge container assembly that provides a sample-tight seal and prevents sample spilling during centrifugation.

These and other objects and advantages are achieved in a removable conformal liner of the present invention. The liner is designed to have a flexible or semi-rigid body with an opening for introducing a sample. When the liner is inserted into an internal cavity of a centrifuge container, the body of the liner conforms to the shape of the interior cavity. The liner body may be made of a material that is sufficiently resilient to allow a reversible deformation of the body by folding, twisting, collapsing, rolling, or pleating. The liner body may be deformed in any way, as long the deformation does not cause irreversible structural damage to the liner. The liner may have a strengthening structure for increasing the strength of the liner body. A liner of this invention may also contain an integrally formed sealing structure for providing a seal between the liner and the centrifuge container when assembled. The sealing structure extends outwardly from the side wall of the liner body and may have an o-ring-like structure.

In another aspect, the present invention provides a removable centrifuge container assembly. The assembly includes a centrifuge container with an interior cavity and an opening, and a removable liner with a flexible or semi-rigid body placed in the container. In one embodiment, the liner body is made of a sufficiently resilient material, which allows a reversible deformation of the liner body. This embodiment is particularly advantageous for use with containers which have a narrow neck. When the liner body is made of a resilient material, it may be deformed in such a way that its dimension is sufficiently reduced so that it can fit through the neck of the container. Once released inside the container, the liner unfolds to allow placement of a sample. The centrifuge container assembly of this invention may also have a retaining-means for retaining the liner in a fixed position within the container. The retaining-means may comprise a first mating element formed on the liner body and a second mating element formed on the container. The first and the second mating elements are capable of engaging each other in order to secure the liner. Alternatively, a top portion of the liner may be draped over the edge of the container opening and secured with a retaining-means, such as a tie wrap or a resilient member.

The present invention also overcomes deficiencies of the prior techniques by providing a method of using removable conformal liners for centrifuge containers in separating the solids from suspensions by centrifugation. In this method, the removable conformal liner of the present invention with a flexible or semi-rigid body is placed into a centrifuge container. Once inside the container, the liner body conforms to the shape of the interior cavity of the container. The step of placing the liner may include deforming the liner body to reduce its dimension and fitting the deformed liner through the container opening. The method may further include a step of immobilizing the liner with a retaining-means. When centrifugation is completed, the liner is removed from the container with the pelleted solids contained in the liner. The pelleted solids on the liner may be either harvested or discarded.

The present invention has been found to provide a number of advantages. The centrifuge container assembly can be used to recover the solids from a broad range of suspensions, which includes, but is not limited to, biological materials, such as cell lysates, blood, urine and culture media, and industrial fluids, such as waste washout liquids and sludge. The invention is particularly advantageous in applications dealing with the recovery of the solids from the diluted samples and in applications where limiting direct exposure of a technician to hazardous pelleted solids is desirable The liner of the present invention can be designed to fit a wide variety of centrifuge containers, including, but not limited to, centrifuge containers used in a swinging bucket, and vertical tube and fixed angle rotors. For example, a centrifuge container assembly of this invention has been found to be useful with swinging bucket rotors JS3.4A and JS-5.0A for Avanti J and J2 family of centrifuges (Beckman Instruments, Fullerton, Calif.).

The liners of this invention can be made disposable, which eliminates the need for the mechanical cleaning of the centrifuge containers and reduces exposure of a technician to hazardous solid materials. The use of such disposable liners also permits the centrifuge containers to be used with the increasing, numbers of suspensions, as the difficulties previously encountered in cleaning the containers of certain pelleted solids become obviated when all that is necessary is to dispose of the liner. For additional convenience, the disposable liners can be sterilized to accommodate the aseptic sample processing or fabricated in a defined particle, clean environment. The liners can be made of a material that is resistant to gamma, E-beam, and ETO sterilizing techniques. The liners may also be made of materials that are puncturable, resistant to freeze-thaw cycles, clear, chemically resistant, or have other properties useful in particular applications. A disposable and sterile liner of the present invention provides an inexpensive and convenient method for the improved recovery of the solids by centrifugation, which makes mechanical cleaning and sterilization of the centrifuge containers unnecessary. Finally, the liners of this invention assist in creating a sample-tight seal between a centrifuge container and a closure, thus preventing the sample from leaking during centrifugation.

The present invention is defined in its fullest scope in the appended claims and is described below in its preferred embodiments.

DESCRIPTION OF THE FIGURES

The above-mentioned and other features of this invention and the manner of obtaining them will become more apparent, and will be best understood by reference to the following description, taken in conjunction with the accompanying drawings, in which:

FIGS. 4A and 4B show retaining the liner with an integrally formed sealing structure. FIG. 4C shows retaining the liner with a closure having an integral o-ring. FIGS. 4D and 4E demonstrate retaining the liner between a closure and the container edge of various configurations.

FIGS. 5C–5F show various configurations of the internal support structure.

DETAILED DESCRIPTION OF THE INVENTION

Figure 1:
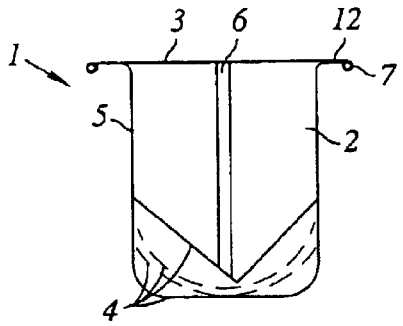
FIG. 1 is a front view of the liner of the present invention, showing various configurations of a bottom portion of the liner.
Figure 2A:
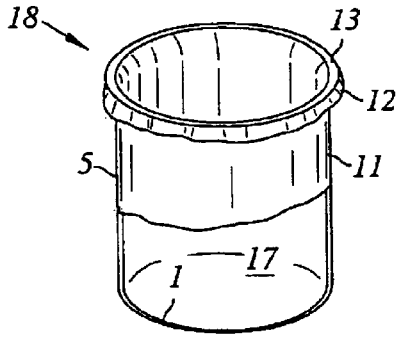
FIG. 2A shows a centrifuge container assembly with a flexible liner.

Referring, to FIGS. 1 and 2A, a removable liner 1 for a centrifuge container embodying the present invention comprises a flexible or semi-rigid body 2 with an opening 3 for introducing a sample. As shown in FIG. 2A, once the liner of this invention is inserted into a centrifuge container 11, the liner body conforms to the interior shape of the container For the purpose of this invention, a flexible or a semi-rigid liner body is made of any material that allows a deformation of the liner body without breakage. The semi-rigid liner body of this invention is a freestanding structure that can maintain its 3-D shape outside of the container, both when empty and when filled with a sample. The flexible liner body, on the other hand, cannot support the weight of a sample on its own outside of the container. Both semi-rigid and flexible liner bodies can be made of a wide range of materials, including, but not limited to, paper, carton, polyethylene, polyvinylchloride (PVC), ethyl vinyl acetate (EVA), polyethylene terephthalate (PETG), urethane, or any other polymer material that meets medical requirements and can be used in a film configuration would work.

Figure 3A:
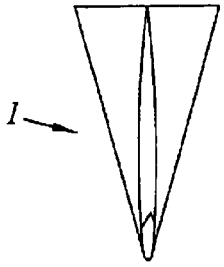
FIGS. 3A–3C are front views shown, deformation of the liner according to embodiments of the present invention.
Figure 3B:
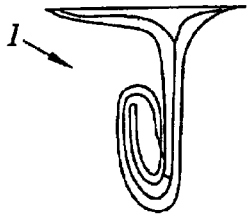
Figure 3C:
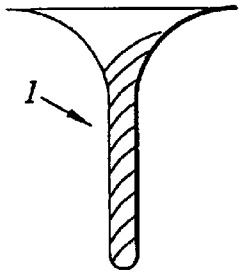

In one embodiment, the liner body is made of a sufficiently resilient material, which allows a reversible deformation of the liner body. For the purpose of this invention, reversible deformation means that the deformed liner body returns to its original shape when the deformation force is released. Examples of reversible deformation include, but are not limited to, pleating (FIG. 3A), rolling (FIG. 3B), twisting (FIG. 3C), folding, and collapsing. The liner body may also be deformed in other ways, as long as the deformation does not cause irreversible structural damage to the liner. The liners, made of resilient materials, are particularly useful for containers with a narrow neck. For example, the liner body may be deformed in such a way that its dimension is sufficiently reduced so that it can fit through the neck of the container. Once released inside the container, the liner unfolds to allow placement of a sample.

The liner of this invention may conform to the shape of the interior cavity of the container due to a clinging property of the liner body. This liner type provides the advantage of remaining in a fixed position inside the container cavity without any additional retaining devices. Alternatively, the liner may conform to the interior cavity as a result of a hydraulic load created by the sample during its introduction into the liner or during centrifugation.

The shape of the liner body is not critical and is chosen to conform to the shape of the interior cavity of the container. For example as shown in FIG. 1, the liner body may have a cylindrical shape with flat, spherical or conical bottom 4 to match the shape of the internal cavity of the container. The cylindrical shape of the liner may be useful when a container with a wide-open mouth is used. The liners of this invention may also contain a strengthening structure for increasing the strength of the liner body. The strengthening structure may be integrally formed on a side wall 5 of the liner body in the form of a fold or a pleat 6 (FIG. 1). The liner of this invention may contain a plurality of such strengthening structures. It should be apparent that other shapes and conformations of the liner could be employed, as long as they conform to the shape of the container internal cavity when inserted into the container Referring to FIGS. 2A and 2B, the length of the liner body 2 may be larger than the depth of the interior cavity of the container 11. Such an arrangement allows the draping of a top portion 12 of the liner, which extends beyond the edge 13 of the container opening, over the edge of the container. In some embodiments, the draped top portion of the liner is fixed in place by a retaining-means 14, shown in FIG. 2B and discussed in detail below.

Figure 4A:
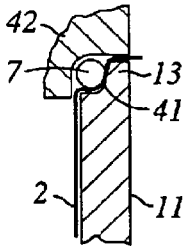
FIGS. 4A–4E are partial cross-sectional views showing liner-retaining means according to embodiments of the present invention.

Referring to FIGS. 1 and 4A, the liner of this invention may contain an integrally formed peripheral sealing structure 7. The sealing structure extends outwardly from the side wall 5 of the liner body. As shown in FIG. 4A, the liner with the sealing structure may be used in conjunction with a centrifuge container having a complementary groove 41 on the external surface of the container side wall. When assembled, the top portion 12 of the liner body may be draped over the edge of the container 13 in such a way that the sealing structure fits into the groove 41 and forms a seal between the liner and the centrifuge container. The sealing structure may be further immobilized within the grove by attaching a closure 42 to the container. Although different shapes of the sealing structures may be used, in a preferred embodiment the sealing structure 7 has an o-ring-like structure.

Figure 5A:
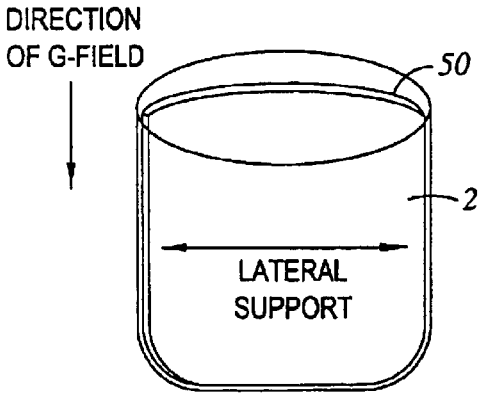
FIGS. 5A and 5B show a liner with a removable internal support structure, which is provided as a separate element (FIG. 5A) or as a part of the closure assembly (FIG. 5B).
Figure 5B:
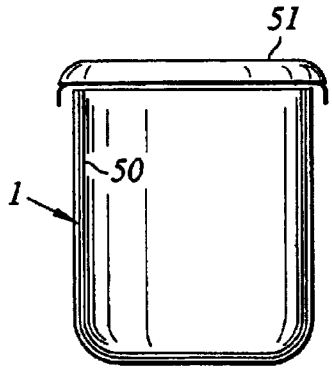
Figure 5E:
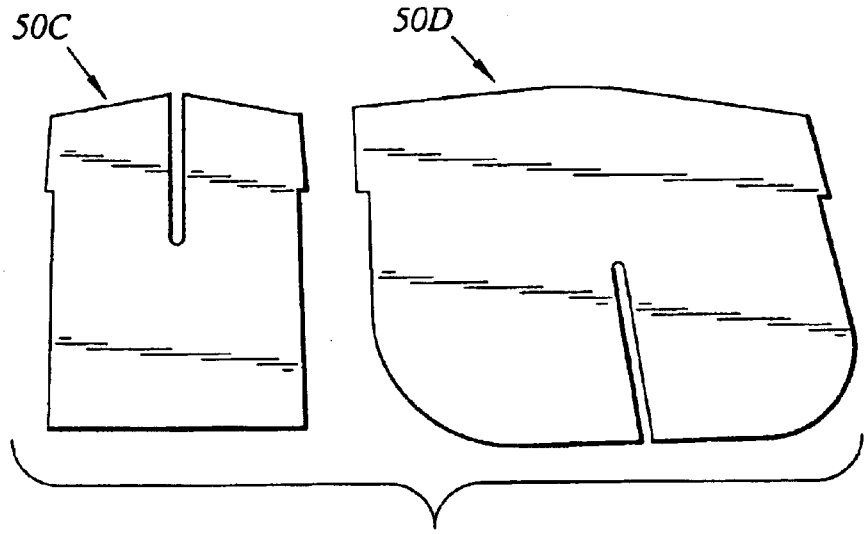
Figure 5F:
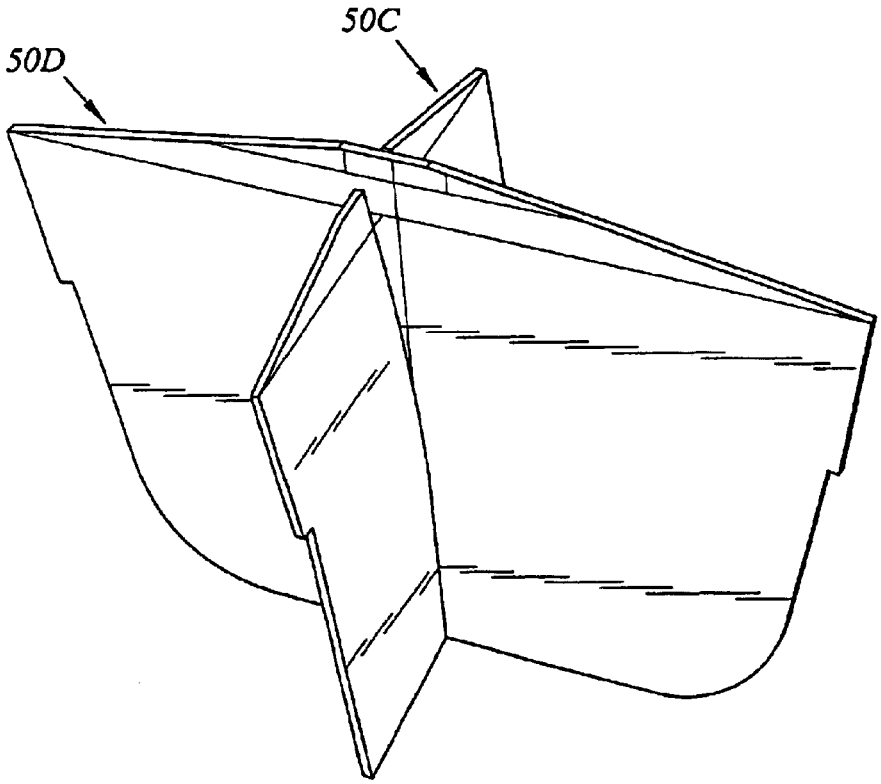

Referring to FIGS. 5A and 5B, the liner of this invention may also contain a removable internal support structure 50 for restraining the liner within the centrifuge container during centrifugation and decanting (the container is not shown in FIG. 5A for clarity). A particular shape of the support structure 50 is not crucial, as long as it provides a lateral restraining support and prevents the liners from collapsing during centrifugation. Referring to FIGS. 5A and 5C–5F, examples of acceptable configurations of the support structure 50 include, but are not limited to, frames (FIG. 5A), curved self-supporting members (FIG. 5C), and multi-axis two-member assemblies (FIGS. 5D–F) Referring to FIG. 5D, multi-axis support structures may include two curved members 30A and 50B designed to support each other. Alternatively, referring to FIGS. 5E and 5F, multi-axis support structures 50C and 50D may be of a snap-together design. When partially filled liners are subjected to centrifugation, the support structure 50 is particularly useful. The support structure 50 is especially advantageous with large (more than 1 L) containers. The support structure 50 may be made of any rigid material. Examples of such materials include, but are not limited to, plastic, laminated paper and cardboard. In one embodiment, the support structure 50 is integrally formed on the internal surface of a closure 51 and has a frame-like structure (FIG. 5B). Such an integral one-piece assembly is advantageous in certain applications, as it simplifies removal of the support structure.

Figure 6A:
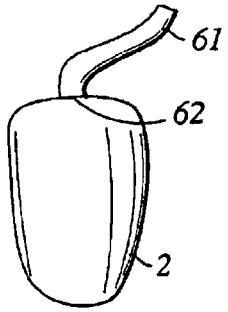
FIGS. 6A and 6B show a liner with a single elongated member (FIG. 6A) and a plurality of elongated members (FIG. 6B).
Figure 6B:
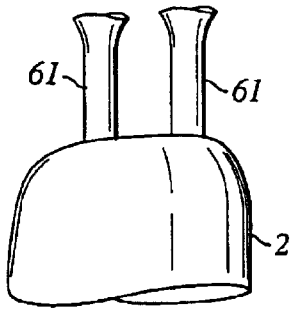

Referring to FIGS. 6A and 6B, the liner of this invention may also contain an elongated hollow member 61 for filling the liner body 2 with the sample, removing trapped air, and discharging supernatant. The elongated member may be attached to or integrally formed with the edge of the liner opening 62 and extended outwardly from the liner body. The size and shape of the elongated member is not crucial as long as it allows filling the liner body with a sample. The liner may have a plurality of such elongated members 61, having either the same or different shape and size (FIG. 6B).

In certain applications, it might be desirable to have disposable liners. Because of the simplicity of the construction and the nature of the materials involved, the liner can be made disposable so it can be discarded after use, which eliminates the need for the mechanical cleaning of the centrifuge containers and reduces exposure of a technician to hazardous solid materials. The use of such disposable liners also permits the centrifuge containers to be used with increasing numbers of suspensions, as the difficulties previously encountered in cleaning the containers of certain pelleted solids become obviated when all that is necessary is to dispose of the liner. For additional convenience, the disposable liners can be pre-sterilized by a manufacturer to significantly reduce the time required for the preparation of the centrifuge containers for the aseptic sample processing by an end-user.

The liner of the present invention can be easily designed to fit a wide range of centrifuge containers by simply changing its shape and size. The liners can be used with virtually any type of centrifuge container, including, but not limited to, jars, bottles, cups, and tubes for use with any centrifuge. In one embodiment, the liners are used with centrifuge containers for the swinging bucket rotor centrifuges. In another embodiment, the liners are used with the centrifuge containers for the fixed angle rotor centrifuge.

Another aspect of the present invention provides a centrifuge container assembly comprising, as illustrated in FIG. 2A, a container 11, suitable for centrifuging, and the removable liner with a flexible or semi-rigid body 2 placed in the container. The centrifuge container has an internal cavity 17 and an opening 18 for receiving a sample. The liner has an opening 3 and a side wall 5, best seen in FIG. 1. When inserted into the cavity of the container, the liner body conforms to the shape of the internal cavity of the container. In some embodiments, the liner is left open after filling with the sample. Alternatively, the liner may be sealed by any method. For example, the liner may be heat sealed (laminated), twisted and tied, zip-locked or sealed with a pressure sensitive adhesive.

Figure 7:
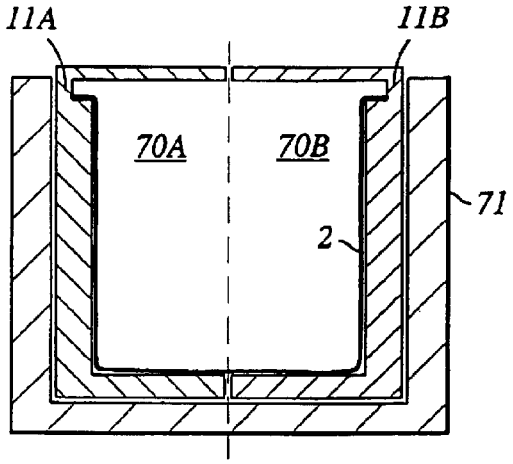
FIG. 7 is a cross-sectional view of a liner placed inside the container, which is formed by two cooperating members according to an embodiment of the present invention.

The container of this invention may be any type of a centrifuge container, including, but not limited to, jars, bottles, cups and tubes for use with any centrifuge. In one embodiment shown in FIG. 7, the centrifuge container comprises a first member 11A with a first cavity 70A and a second member 11B with a second cavity 70B. The first and the second members cooperate to form the interior cavity of the container for receiving the liner. While a semi-rigid liner may be placed between members 11A and 11B unsealed, a flexible liner may be required to be sealed prior to the container assembling. In one embodiment, shown in FIG. 7, the liner 2 is fully enclosed and sealed between the members 11A and 11B. The methods and means of assembling two cooperating structures are well-known in the art. For example, one member may have a plurality of recesses and the other member may include a plurality of corresponding projections. The projections fit closely into the recesses and snap-lock when fitted therein. Any other structures for connecting two members may be employed, as long as they provide a secure assembly.

Figure 2B:
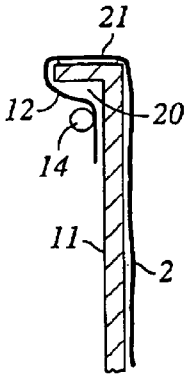
FIGS. 2B–2D are cross-sections of a top portion of the centrifuge container assembly showing various configurations of the liner-retaining means with a lip structure formed on the container according to embodiments of the present invention.

As shown in FIGS. 2A and 2B, the centrifuge container assembly of this invention may have a liner with a top portion 12 extending beyond the edge 13 of the container opening. The top portion 12 may be draped over the edge 13, as shown in FIG. 2A.

Referring to FIGS. 5A and 5B, the centrifuge container assembly may include a closure 42A or 42B for closing the container and confining the sample within. In one embodiment, closure 42A is screwed onto the container by means of a thread 81 (FIG. 5A). In another embodiment, a stopper-like closure 42B, without a thread, is used (FIG. 8B). In both embodiments, the interior surface 83 of the closure rests on the edge 13 of the container opening and immobilizes the draped top portion 12. When the closure is tightened, it applies a downward force to the top portion of the liner and forces it to confirm to the configuration of the container edge. Consequently, the liner fills voids between the closure and the container and improves integrity of the seal therebetween.

Referring to FIG. 8B, the embodiment, utilizing a stopper-like closure 42B, is mostly useful with, but not limited to, swinging bucket applications, where axial loading is in line with the center axis of the container. The liner used in this configuration may be either flexible or semi-rigid. The semi-rigid liner may be more convenient in certain applications, because it would stay in place while the closure is being inserted. Also, a semi-rigid liner does not fold or collapse as the fluid level is lowered due to decanting of the liquid sample. Retaining-means, which will be discussed below, may be required to keep a flexible liner in place while the closure is inserted.

Figure 8A:
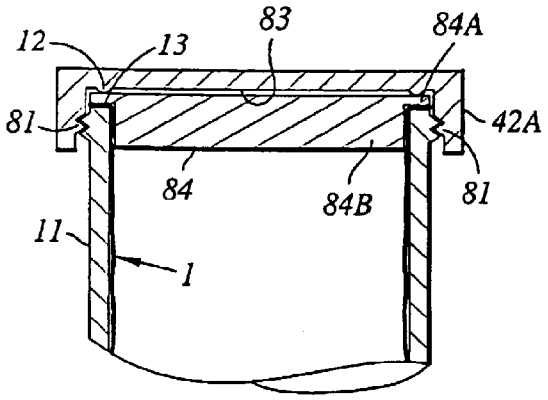
FIGS. 8A–8C are cross-sectional views of the top portion the of centrifuge container assembly with a screw-on closure (FIG. 8A) or a stopper-like closure (FIGS. 8B and 8C) according to embodiments of the present invention.
Figure 8B:
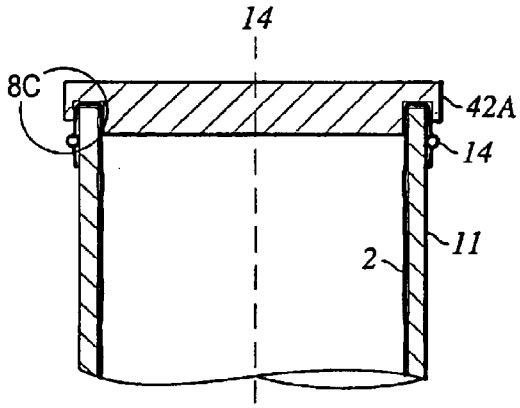
Figure 8C:
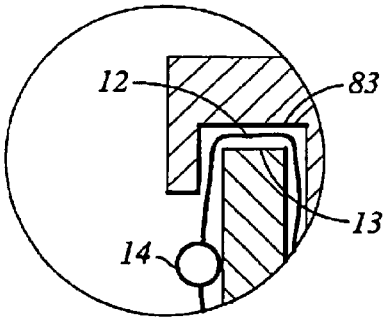

Referring to FIG. 8A, the threaded closure 42A may be used in conjunction with a plug 84 for further improving the sample-tight seal between the closure and the container. The plug has a top portion 84A and a bottom portion 84B. The bottom portion of the plug is inserted into the liner opening, and the top portion of the plug rests on the edge 13 of the container between the closure 42A and the liner 1. When the threaded closure 42A is tightened, the plug transfers the downward force from the closure to the liner and forces the liner to conform to the configuration of the container edge and the thread. Consequently, the plug 84 further improves the seal between the closure and the container. This type of the centrifuge container assembly is particularly useful with the fixed angle and swinging bucket applications. Since, in these applications, samples may come into contact with the closure, a leak-proof seal between the container and the closure is especially important.

In some embodiments, the centrifuge container assembly may contain retaining-means for retaining the liner in a fixed position within the container. The retaining-means may comprise a tie wrap or a resilient member 14 placed on top of the draped top portion 12 of the liner, as shown, for example, in FIG. 2B. The resilient member may be any structure that conforms to the outside surface of the container and retains the liner in place. Examples of suitable resilient members include, but are not limited to, rubber and elastic bands, o-rings, and the like, as would be known to those skilled in the art.

Alternatively, the retaining-means may comprise two mating elements, one formed on the liner body and the other formed on the container. The mating elements engage each other in order to secure the liner.

Figure 4B:
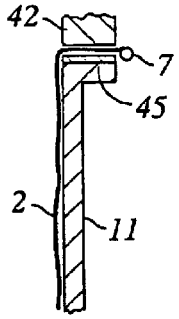
Figure 4C:
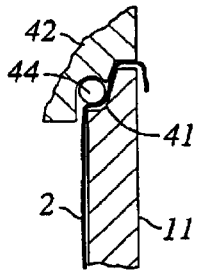

In one embodiment shown in FIG. 4A, the first mating element is a peripheral sealing structure 7 integrally formed with the liner body and projected outwardly from the liner side wall, and the second mating element is a groove 41 formed on the container side wall (FIG. 4A). When a closure 42 is tightened, the sealing structure becomes immobilized within the groove 41. Alternatively, as shown in FIG. 4C, the closure 42 itself may have an o-ring structure 44. The o-ring structure on the closure presses the liner into the container groove 41, immobilizing the liner and forming a tight seal with the container.

The liner with the integral peripheral sealing structure 7 may also be used with a container without a matching groove. For example, as shown in FIG. 4B, the liner may be draped over the edge of the container having a sealing surface 45 and immobilized by a closure 42. Once attached, the closure traps the sealing structure 7 of the liner on the outside of the container, preventing the liner from being pulled inward.

Figure 4D:
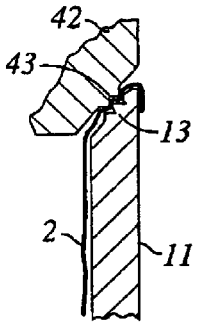
Figure 4E:
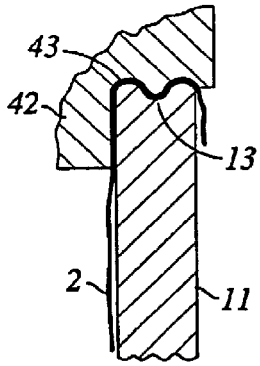

Referring to FIGS. 4D and 4E, the centrifuge container assembly of this invention may further comprise a container closure 42 having an internal surface 43 in contact with and conforming to the container edge 13. In these embodiments, the container edge 13 forms one mating element and the internal surface 43 of the closure forms another mating element of the retaining means. These mating elements engage each other in order to restrain the liner from moving. For example, the edge 13 of the container may be serrated and angled with respect to the centerline A—A of the container 11 and the internal surface 43 of the closure 42 may have a matching serration (FIG. 4D). When the closure is tightened on the container, the liner is forced to fill gaps between the mating surfaces of the closure and the container, locking the liner in place and forming a liquid-tight seal. In another example shown in FIG. 4E, the edge 13 of the container has a convoluted profile and the internal surface 43 of the closure 42 has a matching configuration. This design has the advantage of increasing the grip on the liner and creating a torturous path for fluid, thus preventing leakage of a sample from the container during centrifugation. Alternatively, a separate gasket may be used to improve the seal between the closure and the container and to fix the liner in place.

Figure 2C:
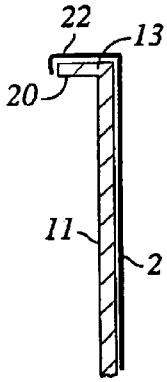
Figure 2D:
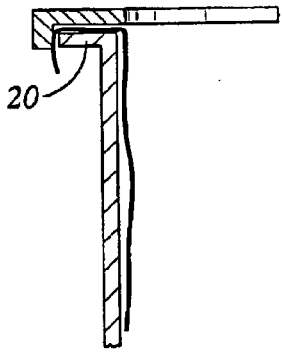

In another embodiment, best seen in FIGS. 2B–2D, one of the mating elements of the retaining means is a lip 20 integrally formed along the container edge 13 and projected outwardly from the edge of the container. When a centrifuge container has a lip, the top portion of the liner is draped over the lip. The draped portion of the liner may be secured with a tie wrap or a resilient member. Alternatively, as shown in FIG. 2B, the liner-contacting surface of the lip 21 may be made of a gripping material to hold the liner in place. For the purpose of this invention, a gripping material is a material with high friction coefficient. The gripping materials are well-known to those skilled in the art, and include, for example, rubbery or gummy materials. Self-loading of the liner material is negligible during centrifugation and does not pull the liner into the container. Yet, the stretching load on the liner is significant enough for the gripping material of the lip to engage the liner.

A semi-rigid liner of this invention may comprise a hook-like structure 22, as shown in FIG. 2C, forming one of the mating elements. The hook-like structure extends outwardly from the liner opening and perpendicularly to the liner side wall and conforms to the shape of the lip. Once the liner is placed into the container, the hook-like structure catches the lip and fixes the liner in place. In this embodiment, the semi-rigid liner is sufficiently rigid to retain the shape of the hook-like structure during sample loading and centrifugation.

Figure 9:
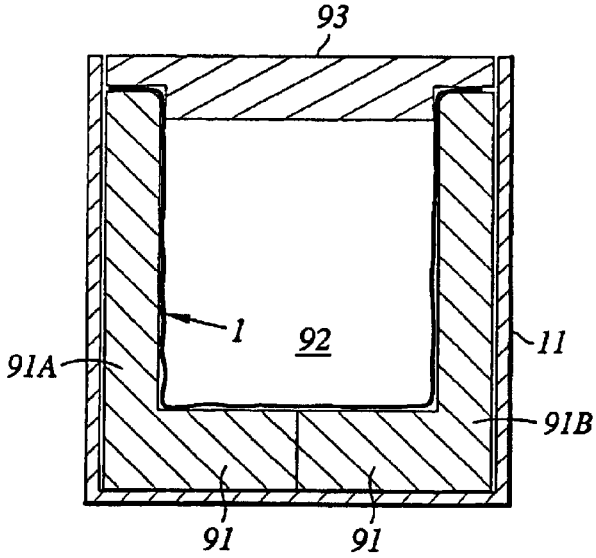
FIG. 9 is a cross-sectional view of the centrifuge container assembly fitted with an adapter according to an embodiment of the present invention.

Referring to FIG. 9, the centrifuge container assembly of this invention may also include and adapter 91 for reducing the size of the internal cavity of the container 11. The adapter has a hollow 92 for receiving the liner, and conforms to the shape and tightly fits within the internal cavity of the container. The liner fits inside the hollow and conforms to its shape. The adapter provides additional flexibility in using centrifuge container assembly of this invention by allowing the use of large containers for centrifuging small sample volumes. Additionally, the adapter allows the reduction of the cross section of the liner, thereby decreasing the length of the particle precipitating path and increasing the efficiency of the centrifugation in fixed angle applications.

In one embodiment, the adapter comprises two members, 91A and 91B, cooperating to form the hollow for receiving and supporting the liner. Such an arrangement simplifies the removal of the liner from the support structure and from the container. Methods and means of assembling two cooperating structures are well-known in the art. For example, one member may have a plurality of recesses and the other member may include a plurality of corresponding projections. The projections closely fit into the recesses and snap-lock when fitted therein. Any other structures for connecting two members may be employed, as long as they provide a secure assembly. Additionally, a plug 93 may be utilized to prevent the escape of aerosols from the sample being centrifugated. The plug also keeps the liner 1 in place during centrifugation. This split removable adapter could be fabricated in different configurations and sizes to fit any centrifuge container.

Another aspect of this invention is directed to a method of separating solids from suspensions by centrifugation. The method comprises the steps of:

a) providing a centrifuge container with an interior cavity and an opening;

b) providing a removable liner comprising a flexible or semi-rigid body with an opening for introducing a sample, and c) placing the liner into the container, wherein once inserted, the liner body conforms to the shape of the interior cavity of the container.

As discussed above, substantially any centrifuge container, including, but not limited to, containers used with the swinging bucket rotor and the fixed angle rotor centrifuges, can be used when practicing the present invention. In accordance with one embodiment of the present invention, the step of placing the liner comprises:

deforming the liner body to reduce its dimension; and fitting the deformed liner through the container opening.

This embodiment is particularly useful when a centrifuge container has a narrow neck. Since the deformed liner has reduced dimensions, it can fit through the neck of the container. Once inside the container, the liner unfolds and conforms to the shape of the interior cavity of the container. The deformation of the liner body may be carried out by any method, including, but not limited to, folding, twisting, collapsing, rolling, pleating, and their combinations.

After placing the liner into the centrifuge container, a liquid sample may be introduced through the open end of the liner by suitable means to fill the liner. The liner may be fully or partially filled. In some embodiments, the liner is left open after filling with the sample. Alternatively, the liner may be sealed by any method. For example, the liner may be heat-sealed (laminated), twisted and tied, zip-locked or sealed with a pressure sensitive adhesive. In one embodiment disclosed in FIG. 7, the centrifuge container comprises a first member 11A with a first cavity 70A and a second member 11B with a second cavity 70B. The first and the second members cooperate to form the interior cavity of the container for receiving the liner. In this embodiment, the liner may be filled with the sample before the step of placing the liner into the container. For example, the liner may be filled with a sample and placed into cavity 70A of the member 11A. The second member 11B is then placed in a facing relation with the member 11A, and members 11A and 11B are assembled to enclose the liner. The entire assembly is then inserted into a rotor bucket 71.

The length of the liner body may be larger than the depth of the internal cavity of the container, and the step of placing the liner into the container may further comprise draping the top portion 12 of the liner over the edge 13 of the container opening, as shown, for example, in FIG. 2A and explained in detail above. The method of separating solids from suspensions by centrifugation may further comprise a step of immobilizing the liner with retaining-means, also disclosed above.

Figure 6C:
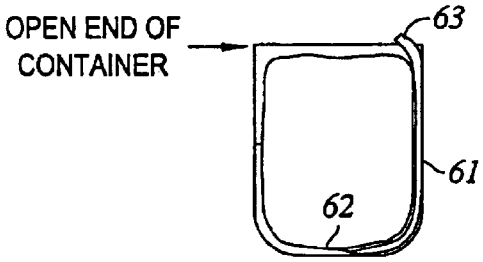
FIG. 6C is a cross-sectional view showing placement of the liner with an elongated member into a centrifuge container according to one embodiment of the present invention.

In one embodiment shown in FIGS. 6A–6C, the liner has an elongated hollow member 61 for introducing the sample and removing trapped air. The elongated member is attached to or integrally formed with the edge of the liner opening 62, and the elongated member extends outwardly from the liner body (FIG. 6A). A juncture 62 is formed at the point where the elongated member 61 attaches to the liner body 2. In this embodiment, the step of placing the liner includes: filling the liner with the sample through the elongated member; sealing the juncture of the liner; and positioning the liner into the container (FIG. 6C). This elongated member may be sealed by mechanical means, such as clamps, by heat sealing, or by bending the elongated member at the juncture. When the bending method is used, the liner may be placed into the container in such a way that the elongated member 61 is bent at the juncture 62 and its open end 63 is snaked to the outside. For example, as shown in FIG. 6C, the liner may be placed so that the juncture 62 is positioned on the bottom of the container and the open end 63 of the elongated member is located at the open end of the container. This placement utilizes the centrifugal forces to pressure-seal the juncture 62 of the liner.

The container assembly filled with the sample may be placed into a centrifuge rotor opening directly or via an adapter. The centrifuge is then operated at a speed and for a period of time necessary to cause the separation of solid and liquid phases. Upon the completion of the centrifugation, a solid pellet is formed on the liner and is covered by a supernatant layer. The amount of the pellet and the volume of supernatant obtained depend on the quantity of the sample and the concentration of the solid phase in the sample. The supernatant is usually decanted and the liner with pelleted solids is removed from the container. When a two-member centrifuge container is used, the liner is removed from the container by separating the two members of the container The pelleted material may, if desired, be harvested by scrapping or by resuspending in a suitable liquid, such as a buffer solution, salinic solution, water, etc. As the solid recovery efficiency is higher in this method compared to conventional ones, this method is particularly beneficial when solids are harvested from diluted samples.

In one embodiment, the liner is disposable. The disposable liner provides additional advantages of convenience, effectiveness of sample processing and centrifuge container cleaning. Using disposable liners is especially advantageous when processing hazardous materials, for example, biohazardous materials, which require minimal direct exposure of a technician to hazardous pellets. In another embodiment, the disposable liners are pre-sterilized, which significantly simplifies the aseptic sample processing.

The present invention extends to the separation of solids from suspensions. A solid is defined herein as any physically separable matter and includes settable solids, suspended solids, colloidal solids, cells and formed elements of blood, e.g., platelets, granulocytes (polymorphonuclear), lymphocytes, monocytes, etc. The suspensions can be a wide range of materials, including, but not limited to, biological materials such as culture media, cell lysates, bodily fluids (e.g., blood and urine), and industrial fluids such as waste washout liquid and sludge containing solid materials.

Thus, the liner of the present invention and the method of its use in separating solids from suspensions are well adapted to attain all of the ends and objects set forth above, together with other advantages which are inherent to the system. The present invention may be embodied in other specific forms without departing from its essential characteristics. The described embodiment is to be considered in all respects only as illustrative and not as restrictive. The scope of the invention is, therefore, indicated by the appended claims rather than by the foregoing description. All changes which come within the meaning and range of the equivalence of the claims are to be embraced within their scope.

What is claimed is:

1. A removable liner for a centrifuge container having an interior cavity and an opening, the liner comprising:

a flexible or semi-rigid body with an opening for introducing a sample, wherein the body of the liner conforms to the interior cavity of the container, once inside the container, and an elongated hollow member for introducing the sample and removing trapped air, wherein the liner body opening has a continuous edge, the elongated member is attached to or integrally formed with the continuous edge of the liner body opening, and the elongated member extends outwardly from the liner body.

2. The liner of claim 1, comprising a plurality of said elongated members.

3. The liner of claim 1, further comprising a strengthening structure for increasing the strength of said liner body, wherein said liner body has a side wall, and the strengthening structure is integrally formed on said side wall of the body.

4. The liner of claim 1, wherein said strengthening structure is a fold or a pleat.

5. The liner of claim 1, wherein said liner is disposable.

* * * * *